US008150282B2

(12) United States Patent
Aoki

(10) Patent No.: US 8,150,282 B2
(45) Date of Patent: Apr. 3, 2012

(54) TONER ADHESION AMOUNT MEASURING APPARATUS, AND TONER ADHESION AMOUNT MEASURING METHOD

(75) Inventor: Kunitoshi Aoki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 12/641,953

(22) Filed: Dec. 18, 2009

(65) Prior Publication Data

US 2010/0166445 A1 Jul. 1, 2010

(30) Foreign Application Priority Data

Dec. 25, 2008 (JP) ..... 2008-330913

(51) Int. Cl.
*G03G 15/00* (2006.01)

(52) U.S. Cl. ..... 399/49

(58) Field of Classification Search ..... 399/49, 399/72

See application file for complete search history.

(56) References Cited

U.S. PATENT DOCUMENTS

| | | | | |
|---|---|---|---|---|
| 2002/0001477 | A1* | 1/2002 | Nakayasu | 399/49 |
| 2009/0317104 | A1* | 12/2009 | Katoh et al. | 399/49 |
| 2010/0166443 | A1* | 7/2010 | Muto | 399/49 |

FOREIGN PATENT DOCUMENTS

| | | | |
|---|---|---|---|
| JP | 62-280869 | A | 12/1987 |
| JP | 8-327331 | A | 12/1996 |
| JP | 9-068830 | A | 3/1997 |

* cited by examiner

*Primary Examiner* — Sophia S Chen
(74) *Attorney, Agent, or Firm* — Canon U.S.A., Inc. IP Division

(57) ABSTRACT

An apparatus includes an irradiation unit configured to irradiate a light onto a toner image, a detection unit configured to detect reflected light from the toner image, and a deriving unit configured to derive a toner adhesion amount of the toner image, based on detection result by the detection unit in measurement range of integer multiple of screen pitch of the toner image.

15 Claims, 20 Drawing Sheets

TONER ADHESION AMOUNT MEASURING APPARATUS, AND TONER ADHESION AMOUNT MEASURING METHOD

BACKGROUND OF THE INVENTION

1. Field of the Invention

The present invention relates to a toner adhesion amount measuring apparatus, and a toner adhesion amount measuring method, for measuring a toner adhesion amount in a toner image formed on an image bearing member of an image forming apparatus.

2. Description of the Related Art

A color of an image formed by an image forming apparatus using an electrophotographic process may be varied due to change of various physical parameters, even if a setting of the apparatus during an image formation is unchanged. In particular, developing/transfer processes have much influence on variation of color. Because, latent image potential, amount of toner applied, transfer efficiency, and the like are varied according to environmental variations of temperature/humidity and the like, and thus an amount of toner adhered onto a photosensitive drum and a transfer belt is not stable.

Thus, an amount of toner adhered onto the photosensitive drum or onto the transfer belt is to be measured to perform feedback controls over exposure amount, developing voltage, transfer current and the like, based on the measurement results, to stabilize the developing/transfer processes.

Generally, these controls are performed at the time points when variation of printer environment occurs. The variation of the printer environment occurs at the time points after toner cartridge replacement, after printing of predetermined number of sheets, and after power of printer body is turned on. When a toner adhesion amount is measured, a plurality of toner patches of various densities ranging from a low density to a high density are formed on a drum or a belt. Then, the toner adhesion amounts of these patches are measured by the toner adhesion amount measuring apparatus, and then various controls are performed under appropriate image forming conditions based on the measurement results.

Japanese Patent Application Laid-Open No. 62-280869 discusses a method for detecting reflected light amount when light is irradiated onto an image bearing member, and reflected light amount when light is irradiated onto a toner patch, measuring a toner adhesion amount using a difference of these reflected light amounts, thereby controlling image density parameters based on the measured values.

In a case where the toner adhesion amount is detected by the reflected light amounts, an average toner adhesion amount of the entire toner patch is measured by irradiating a light with a spot diameter larger than a screen period of the toner patch, and by totally detecting the reflected light from the entire toner patch.

Japanese Patent Application Laid-Open No. 8-327331 and Japanese Patent Application Laid-Open No. 9-68830 discuss a method for detecting a toner adhesion amount by measuring thickness of a toner patch (layer thickness) by a laser displacement gauge. The method includes irradiating a spot light onto an image bearing member and a toner image, causing the reflected light to form an image at a position depending on the layer thickness of the toner patch adhered onto the image bearing member, measuring the toner adhesion amount based on change of image-formed position, and performing feedback control of image density parameters of an imaging system based on result of layer thickness measurement.

For a toner patch having a screen structure, the toner adhesion amount is determined by measuring sectional profile (line height and line width) of screen lines, by scanning irradiated light with a spot diameter smaller than a screen period, onto the toner patch.

To scan the irradiated light onto the toner patch, there is a method to rotate a roller by a motor or the like, to move the toner patch in a horizontal direction together with the image bearing member, while the toner adhesion amount measuring apparatus is fixed within the image forming apparatus.

However, there is a backlash in a driving system for rotating the motor and the roller. As a result, even if driving of the image bearing member and measurement are started at the same timing at each time, the ranges to be actually measured may not always coincide with each other.

Further, since installation position of the toner adhesion amount measuring apparatus within the image forming apparatus also has a difference for each individual element, the measurement range varies also from one image forming apparatus to another.

There may be an issue that deviation of the measurement range causes errors in measured values of the toner patch having a periodicity in a screen.

As illustrated in FIG. 20, a reflection position signal and a reflected light amount signal from the toner patch included within the same measurement range vary between a case where a measurement starting position and an edge of the screen coincide with each other (phase 0), and a case where a measurement starting position and an edge of the screen deviate from each other (phase 1/4, −1/4). Therefore, the toner adhesion amounts calculated from these varying reflected signals also vary, and the variation of the adhesion amounts causes errors of measured values. As a result, the measurement accuracy of the toner adhesion amounts decreases.

SUMMARY OF THE INVENTION

According to an aspect of the present invention, an apparatus for measuring a toner adhesion amount of a toner image formed on an image bearing member of an image forming apparatus includes an irradiation unit configured to irradiate light on the toner image, a detection unit configured to detect reflected light from the toner image, and a deriving unit configured to derive the toner adhesion amount, based on detection result by the detection unit in measurement range of integer multiple of screen pitch of the toner image.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Now, a first exemplary embodiment will be described. In the first exemplary embodiment, a measurement range is defined to integer multiple of screen pitch by controlling exposure time of an image sensor.

Figure 1A:
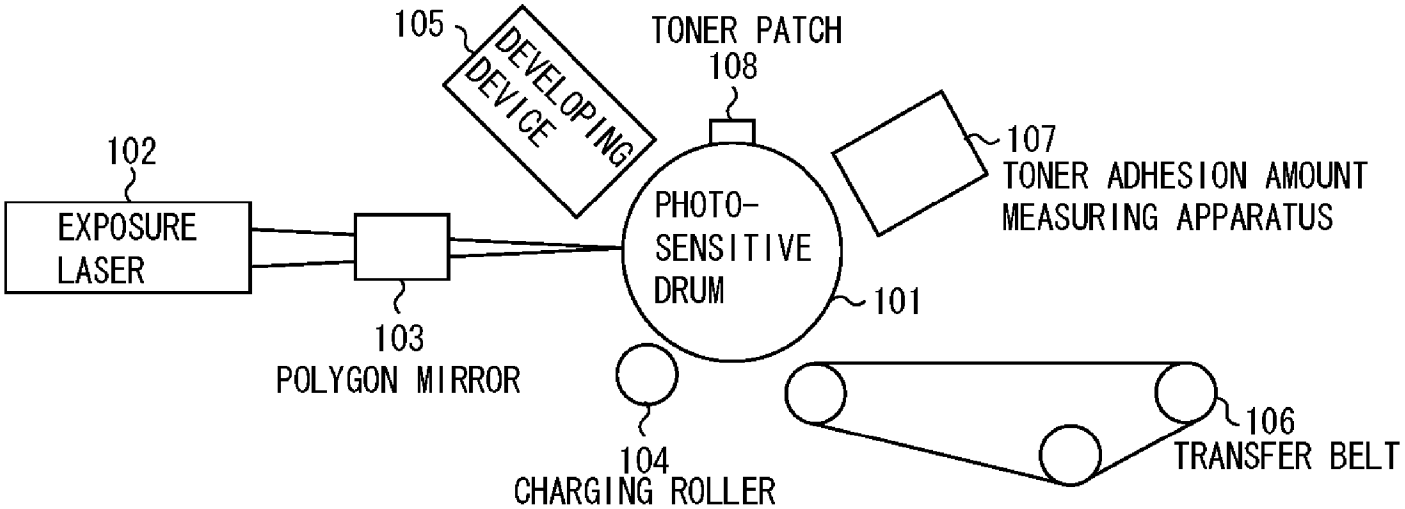
FIGS. 1A and 1B illustrate configurations of an image forming apparatus of electrophotographic process according to a first through fourth exemplary embodiments.

FIG. 1 illustrates a configuration of an image forming apparatus of electrophotographic process according to the first exemplary embodiment, and a second through a fourth exemplary embodiments as will be described below. The image forming apparatus illustrated in FIG. 1A includes a photosensitive drum 101 serving as an image bearing member, an exposure laser 102, a polygon mirror 103, a charging roller 104, a developing device 105, a transfer belt 106, and a toner adhesion amount measuring apparatus 107.

First, the image forming apparatus charges a surface of the photosensitive drum 101 by the charging roller 104, and generates an electrostatic latent image using a laser and a mirror. Next, the image forming apparatus forms a toner patch 108 on the photosensitive drum 101 by the developing device 105, and measures a toner adhesion amount of the toner patch 108 by the toner adhesion amount measuring apparatus 107 installed at a position after developing.

Figure 1B:
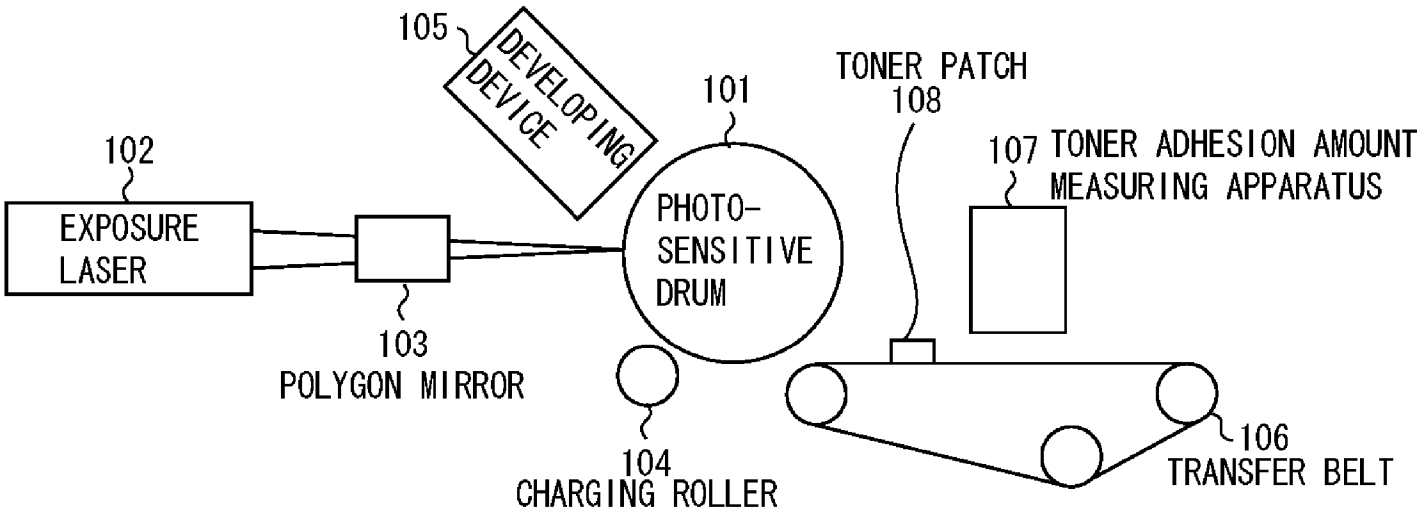

As illustrated in FIG. 1B, after the toner patch 108 is transferred from the photosensitive drum 101 to the transfer belt 106, toner adhesion amount measurement may be performed on the transfer belt 106. The toner adhesion amount measuring apparatus 107 is an example of a toner adhesion amount measuring apparatus.

Figure 2:
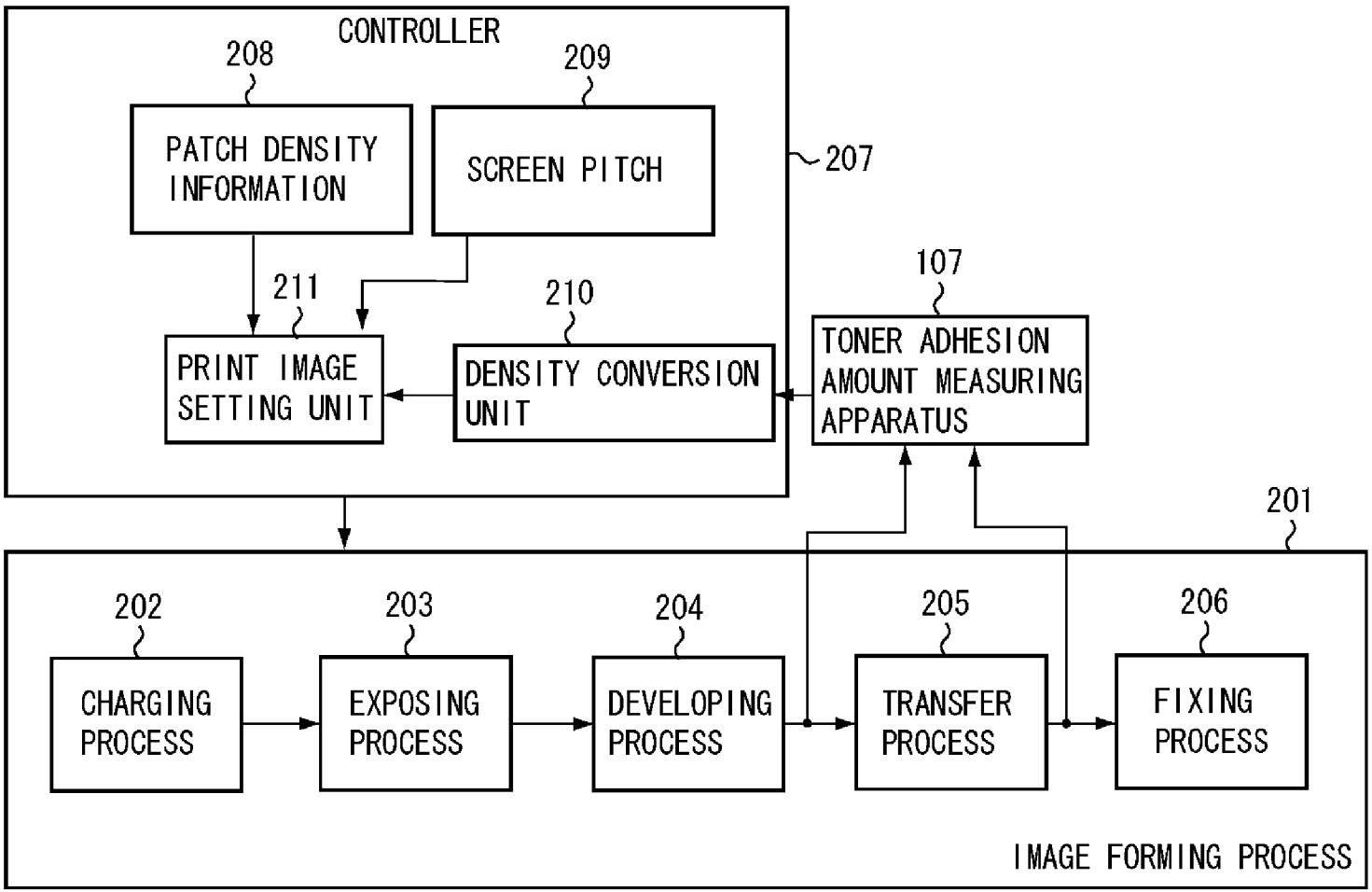
FIG. 2 is a block diagram illustrating a control configuration when an image forming process is controlled by a controller, based on adhesion amount data measured by a toner adhesion amount measuring apparatus.

FIG. 2 is a block diagram illustrating a control configuration when an image forming process 201 is controlled by a controller 207, according to toner adhesion amount data measured by the toner adhesion amount measuring apparatus 107.

The controller 207 sets a density of the toner patch to be printed by a print image setting unit 211 and a screen, based on patch density information 208 and a screen pitch 209, and drives the image forming process 201. The toner patch is formed with desired density on the photosensitive drum 101 in FIG. 1, after having undergone each of a charging process 202, an exposing process 203, and a developing process 204, or on the transfer belt 106 after having undergone a transfer process 205.

Then, the toner adhesion amount measuring apparatus 107 measures a toner adhesion amount of the formed toner patch 108, and feeds back the measured toner adhesion amount data to the controller 207. The formed toner patch 108 is transferred to a medium. The transferred toner patch is fixed in fixing process 206 and it is outputted as a printed material The fed back toner adhesion amount data is converted to density values by a density conversion unit 210. The controller 207 compares toner patch density information (set value) previously set by the print image setting unit 211, with density (measured values) actually measured by the toner adhesion amount measuring apparatus 107, and corrects appropriately the print image setting unit 211 based on the data.

Figure 3:
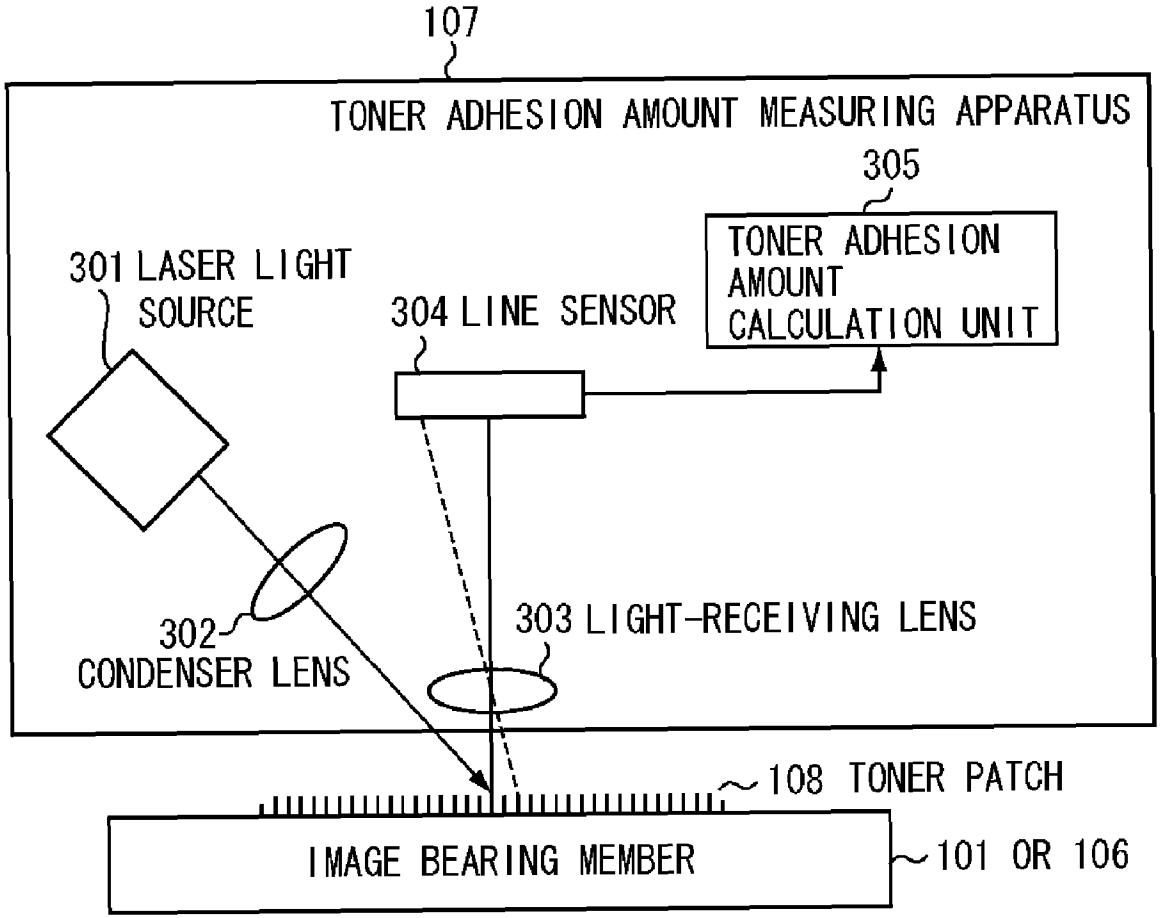
FIG. 3 illustrates a configuration of the toner adhesion amount measuring apparatus.

FIG. 3 illustrates a configuration of the toner adhesion amount measuring apparatus 107. The toner adhesion amount measuring apparatus 107 includes a laser light source 301, a condenser lens 302, a light-receiving lens 303, a line sensor 304, and a toner adhesion amount arithmetic operation unit 305. The laser light source 301 irradiates a light on the photosensitive drum 101, or on the transfer belt 106 (hereinafter, referred to as an image bearing member) and on the toner patch 108 (on the toner image). The condenser lens 302 condenses the laser light into a small spot shape. The light-receiving lens 303 image-focuses reflected light on the line sensor 304, depending on layer thickness of the toner patch. The line sensor 304 captures reflected waveforms of the light focused by the light-receiving lens 303. The toner adhesion amount arithmetic operation unit 305 arithmetically operates a toner adhesion amount based on signals detected by the line sensor 304.

The laser light source 301 is an example of an irradiation unit, and the line sensor 304 is an example of a detection unit. Further, a driving unit for the image bearing member is an example of a scanning unit.

A procedure for measuring a toner adhesion amount, and reflected waveforms detected by the line sensor 304 will be described with reference to FIG. 4.

Figure 4A:
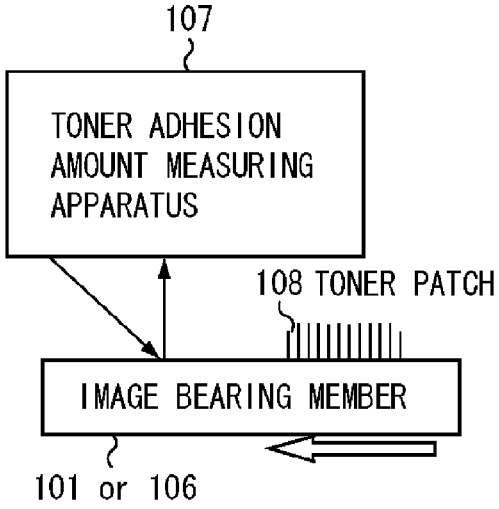
FIGS. 4A, 4B, 4C, 4D illustrate a procedure for measuring a toner adhesion amount, and reflected waveforms detected by a line sensor.
Figure 4B:
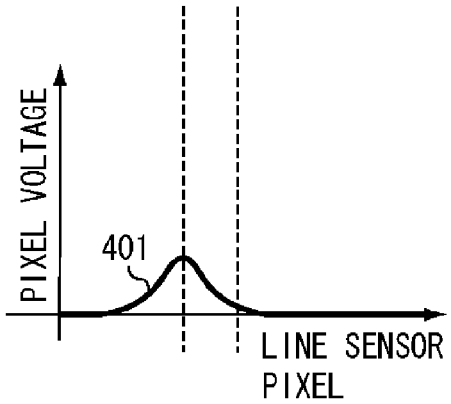

When a toner adhesion amount is measured, as illustrated in FIG. 4A, first, the laser light source 301 irradiates laser light on a surface of the image bearing member on which the toner patch 108 is not formed, and the line sensor 304 detects a reflected waveform 401 illustrated in FIG. 4B.

Figure 4C:
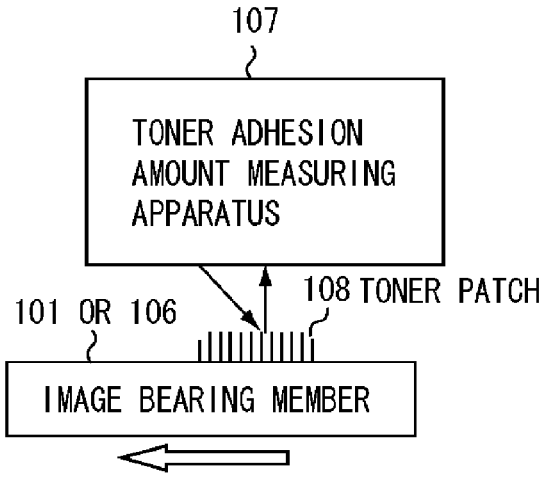
Figure 4D:
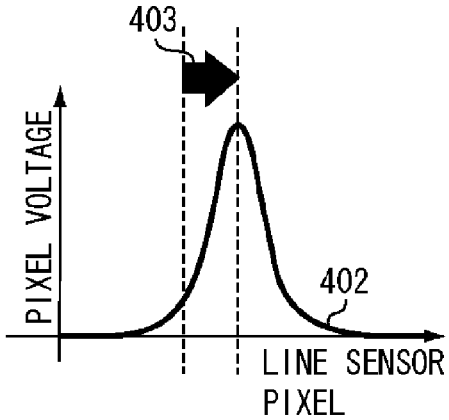

Next, as illustrated in FIG. 4C, the driving unit drives the image bearing member, so that the laser irradiation position is moved to the toner patch 108 portion, and the line sensor 304 detects a reflected waveform 402 from the toner patch illustrated in FIG. 4D. The toner adhesion amount arithmetic operation unit 305 performs signal processing, which will be described below, on the reflection waveform data. The reflection waveform data is obtained from the reflected waveform 401 (reference) and the reflected waveform 402 obtained from the toner patch (change portion) on the image bearing member. Then, the toner adhesion amount arithmetic operation unit 305 arithmetically operates the toner adhesion amount by calculating change amount of data detected in respective reflection portions.

Figure 5:
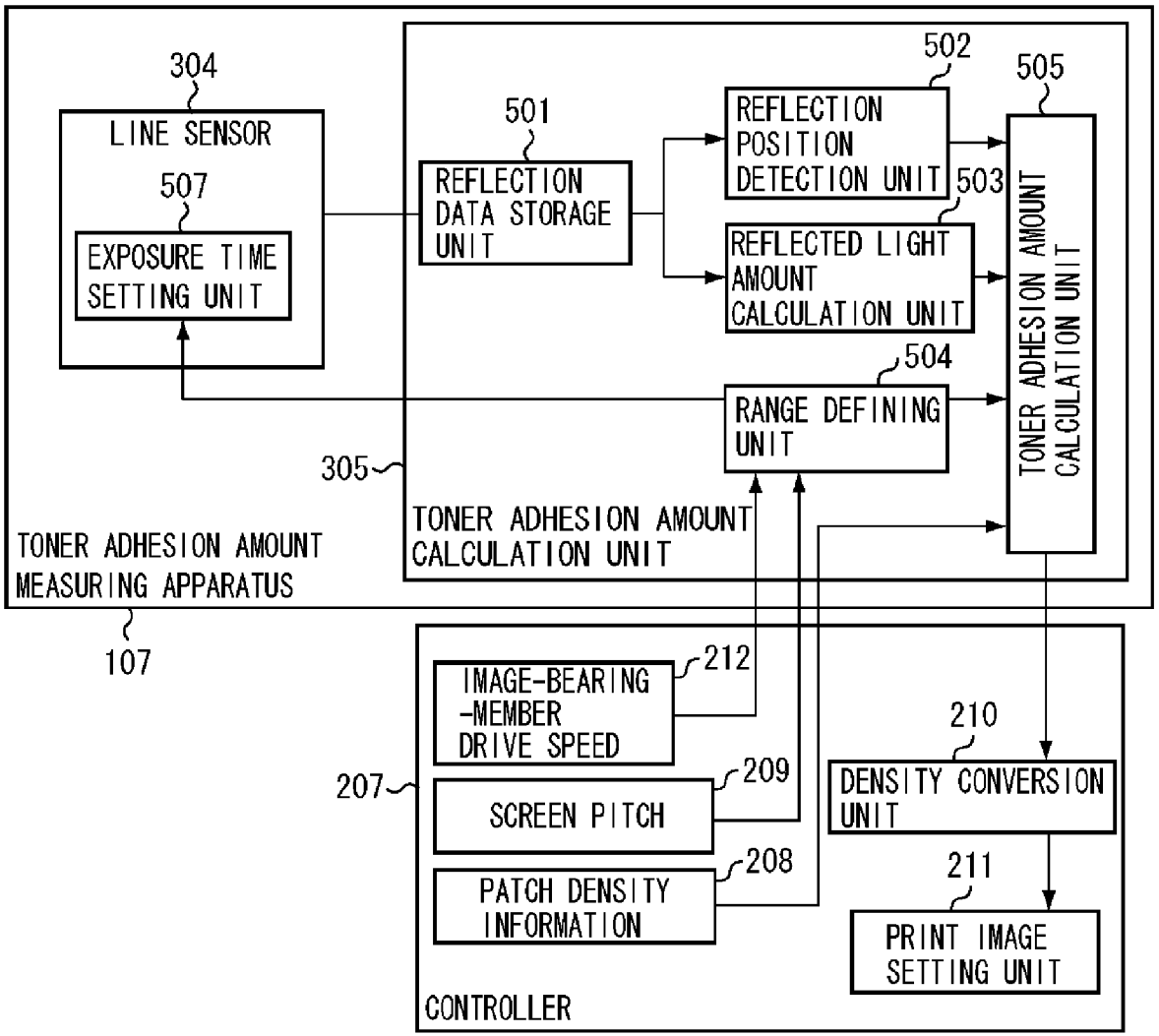
FIG. 5 is a block diagram for illustrating a process of arithmetic operation of a toner adhesion amount according to the first exemplary embodiment.

Next, a process of arithmetic operation of the toner adhesion amount according to the first exemplary embodiment will be described with reference to the block diagram of FIG. 5.

The reflection waveform data detected by the line sensor 304 is stored in a reflection data storage unit 501. A reflection position detection unit 502 detects a reflection position by detecting a peak position (i.e., the highest intensity) of the reflection waveform data stored in the reflection data storage unit 501, and detects a peak shift amount 403 in FIG. 4D, which has changed between the image bearing member and the toner patch.

A reflected light amount calculation unit 503 calculates an area of peak portion (area of region surrounded by peak portion and line sensor axis) of the reflection waveform data stored in the reflection data storage unit 501, to detect change amount of the reflected light amount reflected at the image bearing member and the toner patch.

Figure 20:
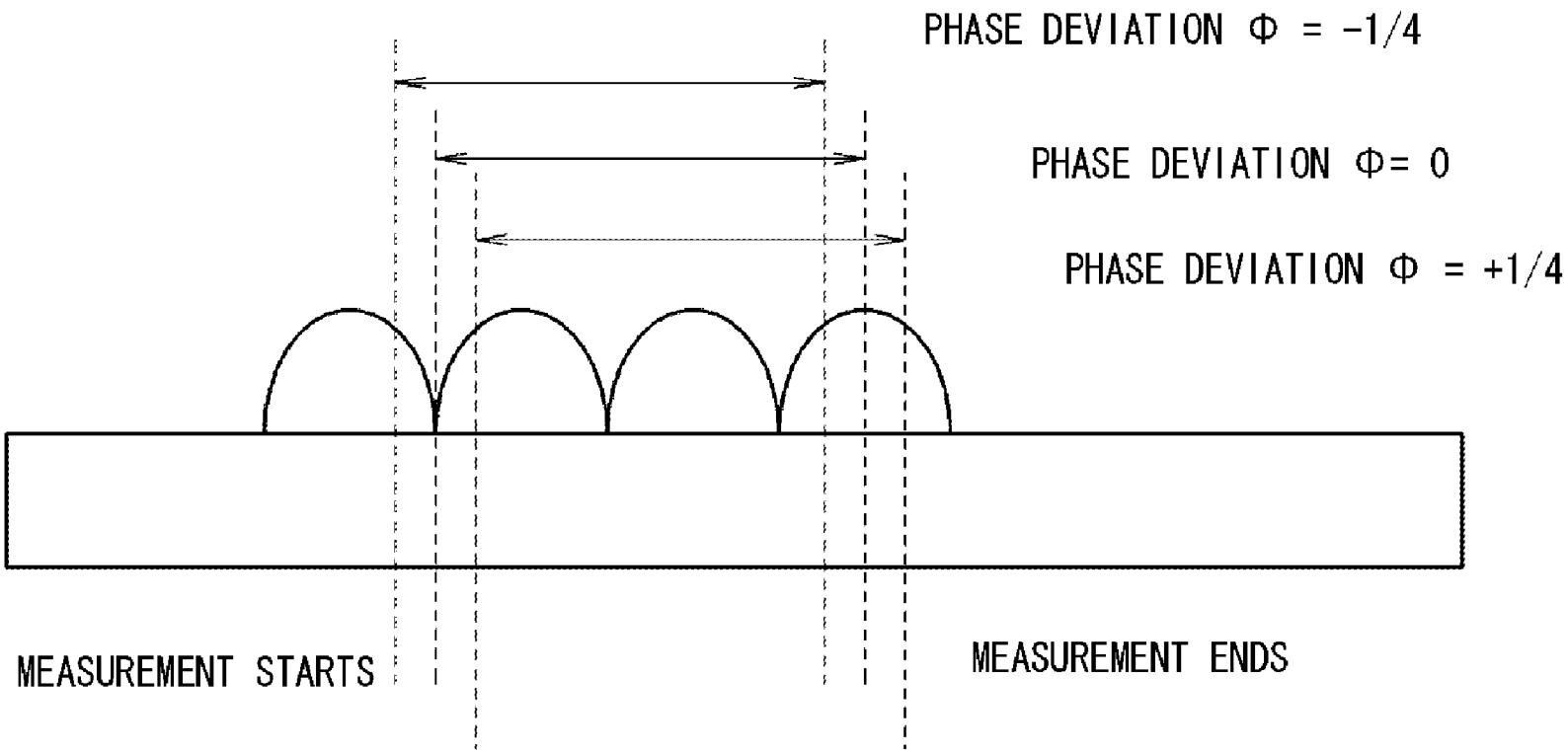
FIG. 20 illustrates measurement range of conventional toner patch.

The reflection position detection unit 502 is an example of a position detection unit. Further, the reflected light amount calculation unit 503 is an example of a light amount calculation unit. As described above, calculation results by the reflected light amount calculation unit 503 and calculation results by the reflection position detection unit 502 are affected by errors of detected values described with reference to FIG. 20.

In the reflection position detection unit 502, a method for detecting peak positions from the reflection waveform data includes, for instance, a method in which a curve fitting using the method of least squares is performed, and then an arithmetic operation is performed to obtain the peak positions using parameters of the Gaussian function after the fitting.

The Gaussian function is a function having a bell-shaped peak with the center of x=μ as given in formula (1), where μ and A are parameters indicating X-coordinate and increase/decrease of height or width of the peak at peak position, respectively.

$$f(x) = \frac{A}{\sqrt{2\pi\sigma^2}} \exp\left\{-\frac{(x-\mu)^2}{2\sigma^2}\right\} + C \tag{1}$$

By fitting the formula (1) to the reflection waveform data, a characteristic amount representing a shape of the reflected waveform can be arithmetically operated as a value of a parameter of the mathematical expression. Further, μ of thus obtained parameter can be used as a reflection position of a light reflected from a sample.

The fitting may be performed to formulas other than the Gaussian function, for instance, Lorentz function formula (2) or quadric expression (3). Further, only maximum value detection may be performed without performing the fitting.

$$f(x) = \frac{2A}{\pi} \cdot \frac{w}{4(x-x_c)^2 + w^2} + C \tag{2}$$

$$f(x) = A(x-B)^2 + C \tag{3}$$

The range defining unit 504 calculates measurement range data based on a screen pitch 209 and an image-bearing-member drive speed 212 (not illustrated in FIG. 1) acquired from the controller 207. A toner adhesion amount calculation unit 505 calculates the toner adhesion amounts based on the data of reflection positions and reflected light amounts, and patch density information 208 acquired from the controller 207 and measurement range data acquired from the range defining unit 504, and feeds the calculated result back to the controller 207.

The screen pitch 209, the image-bearing-member drive speed 212, and the patch density information 208 are recorded in a recording medium such as a random-access memory (RAM) installed in the image forming apparatus. The range defining unit 504 is an example of setting unit. Further, the toner adhesion amount calculation unit 505 is an example of a calculation unit.

Figure 6:
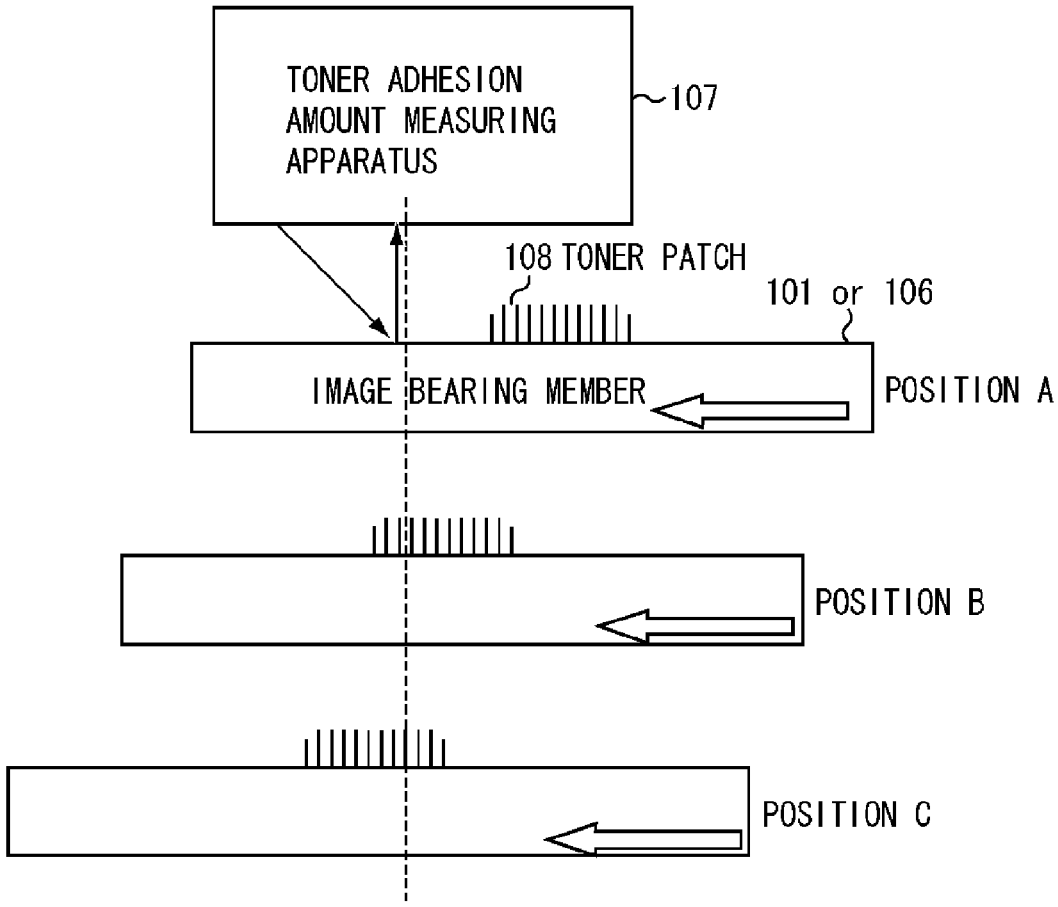
FIG. 6 illustrates a method for calculating a measurement range of a range defining unit.

Next, a method for calculating measurement range of the range defining unit 504 in the present exemplary embodiment will be described with reference to FIG. 6.

When the toner adhesion amount measurement is performed, the range defining unit 504 drives the image bearing member 101 or 106, and captures and measures reflected waveforms for only a certain exposure time by the line sensor 304. The reflected waveforms are obtained from image bearing member surface and the toner patch 108, which are scanned with the laser light.

First, the range defining unit 504 captures and stores the reflected waveform for only exposure time Texp1 at a position A, at which a laser light is irradiated, of the image bearing member portion on which the toner patch is not formed. Next, the range defining unit 504 performs capturing and storing in succession for only an exposure time Texp2, from a position B to a position C where the laser light is irradiated onto the toner patch 108.

In the present exemplary embodiment, a range definition of measurement is implemented by defining the exposure time Texp2 during which the toner patch 108 is measured, to a time equivalent to integer multiple of the screen pitch. More specifically, the range defining unit 504 acquires the screen pitch 209 and the image-bearing-member drive speed 212 from the controller 207, calculates the exposure time Texp2 of the line sensor 304, and sets it in the exposure time setting unit 507 of the line sensor 304. The exposure time Texp2 can be calculated by the following formula (4) as a transit time during which the irradiated light crosses over screen lines.

In the image forming apparatus according to the present exemplary embodiment, the screen pitch is switched among a plurality of screen pitches depending on a type of input image or type of toner. Therefore, the toner patch is formed in a plurality of screen pitches. For this reason, the range defining unit 504 defines a measurement range using the screen pitch 209 of the toner patch to be measured.

$$T_{exp2}=np/V(n=1,2,\ldots) \quad (4)$$

Figure 7:
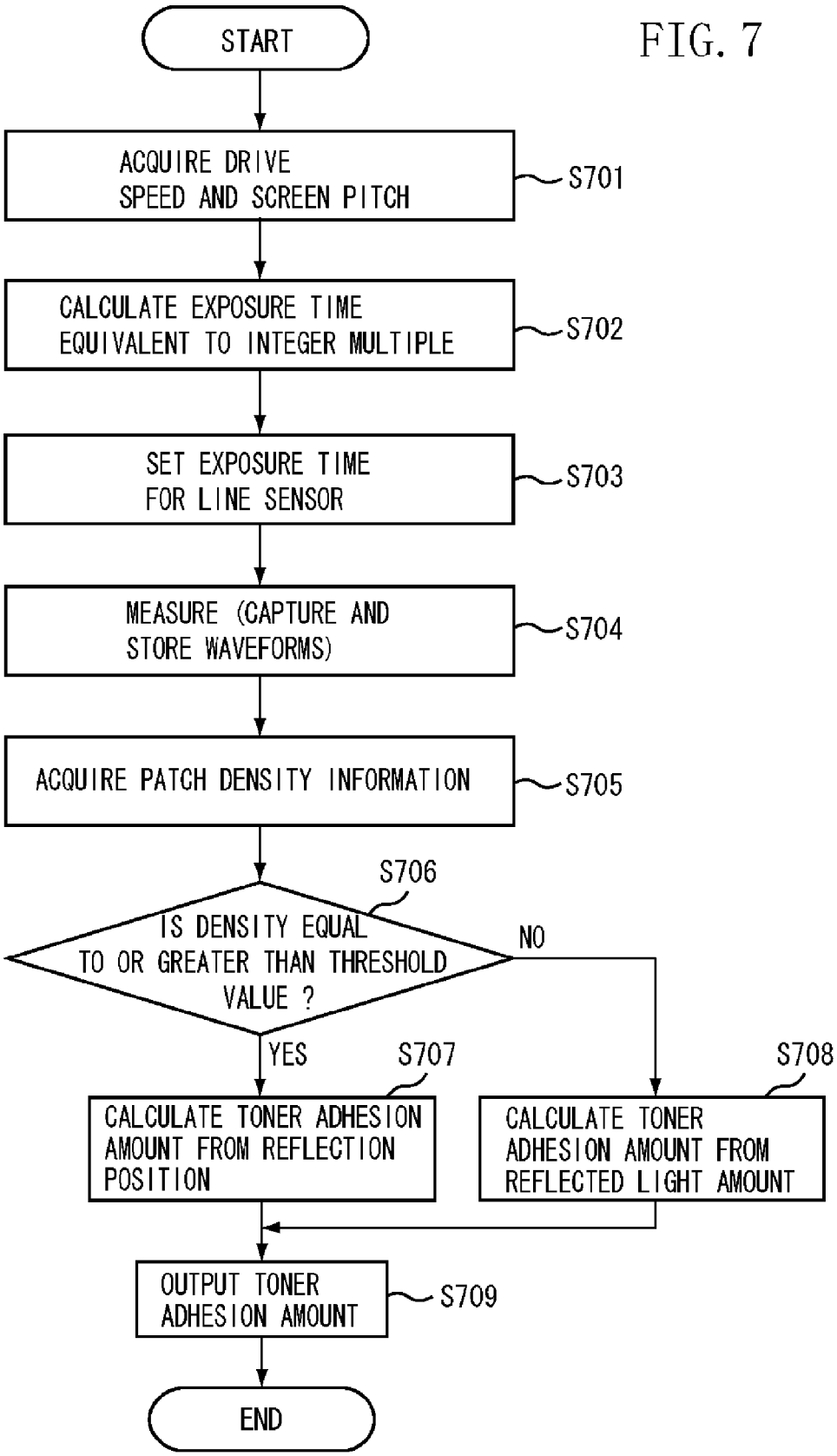
FIG. 7 is a flowchart illustrating processing of a toner adhesion amount arithmetic operation unit according to the first exemplary embodiment.

FIG. 7 is a flowchart illustrating processing of the toner adhesion amount arithmetic operation unit 305 according to the first exemplary embodiment.

In step S701, the range defining unit 504 acquires the image-bearing-member drive speed 212 and the screen pitch 209 from the controller 207. Then, in step S702, the range defining unit 504 calculates an exposure time equivalent to integer multiple of the screen pitch 209. Then in step S703, the range defining unit 504 sets calculated exposure time for the line sensor 304.

Then in step S704, the line sensor 304 captures reflected waveforms, and the reflection waveform data is stored in the reflection data storage unit 501. Then, in step S705, the toner adhesion amount calculation unit 505 acquires the patch density information 208 from the controller 207.

Then in step S706, the toner adhesion amount calculation unit 505 performs a density evaluation by comparing with a threshold value. In other words, if the patch density information is equal to or greater than a threshold value (YES in step S706), the toner adhesion amount calculation unit 505 determines the patch density as a high density region where accuracy by reflection position detection is high. And, instep S707, the toner adhesion amount calculation unit 505 calculates a toner adhesion amount from reflection position data. The toner adhesion amount calculation unit 505 calculates toner adhesion amount data from the reflection position data, based on relationship between the reflection position data (change amount of peak positions) defined by a lookup table (LUT a) and the toner adhesion amount.

On the other hand, if the patch density information is less than the threshold value (NO in step S706), the toner adhesion amount calculation unit 505 determines the patch density as a low density region where accuracy by reflected light amount detection is high. And in step S708, the toner adhesion amount calculation unit 505 calculates a toner adhesion amount from reflected light amount data. The toner adhesion amount calculation unit 505 calculates toner adhesion amount data from the reflected light amount data, based on relationship between the reflected light amount data (change amount of peak area) defined by the lookup table (LUT"b") and the toner adhesion amount. The LUT "a", and LUT "b" can be substituted by a predetermined function.

Then in step S709, the toner adhesion amount calculation unit 505 outputs the calculated toner adhesion amount. The image forming apparatus controls various parameters (image forming parameters) such as exposure amount, developing voltage, transfer current, based on the output toner adhesion amount.

The controller 207 controls the image forming apparatus, based on the toner adhesion amount measured with high accuracy by the above-described toner adhesion amount measuring apparatus 107. Thus, in the present exemplary embodiment, a range within which the toner image is measured, is defined to a measurement range equivalent to integer multiple of the screen pitch.

Therefore, even if phase between measurement starting position and screen period changes, variation of the reflected light to be detected can be suppressed, and errors of the toner adhesion amount measurement can be reduced and measurement accuracy can be enhanced.

Next, a second exemplary embodiment will be described. Hereinbelow, a method for measuring a toner adhesion amount according to the second exemplary embodiment will be described.

In the present exemplary embodiment, when the image bearing member and the toner image are sampled to be measured in a short exposure time, and the toner adhesion amount is arithmetically operated from obtained reflection position data and reflected light amount data, number of data to be used in the arithmetic operation is defined to an amount equivalent to integer multiple of the screen pitch. Accordingly, the measurement range is defined. In the present exemplary embodiment, the same reference numerals are designated to the elements and parts, which are similar to those of the first exemplary embodiment, and the detailed description will be omitted.

Figure 8:
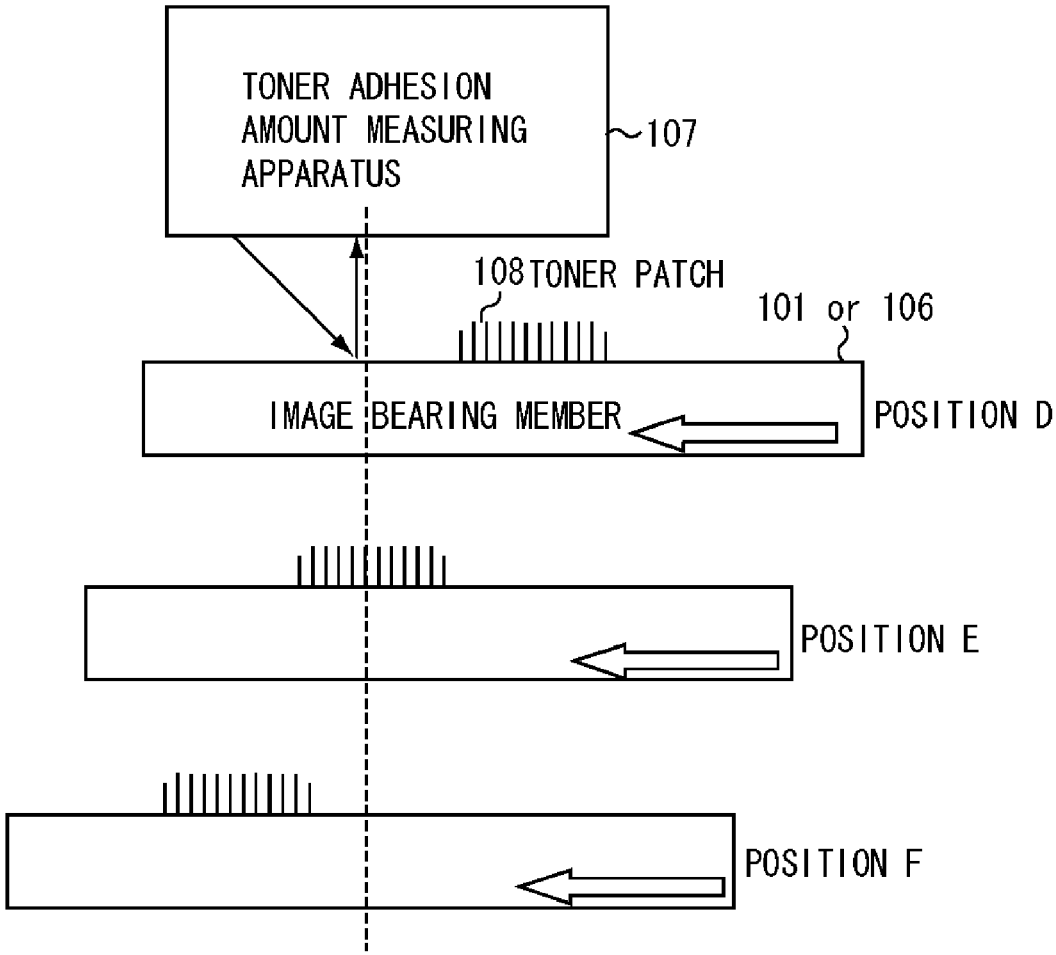
FIG. 8 illustrates a procedure for measuring a toner adhesion amount according to the second exemplary embodiment.

A procedure for measuring a toner adhesion amount in the present exemplary embodiment will be described with reference to FIG. 8. Upon driving the image bearing member 101 or 106, the toner adhesion amount measuring apparatus 107 captures and stores the reflected waveform from the image bearing member surface and toner patch 108, which are scanned by the laser light.

When the measurement starts, the toner adhesion amount measuring apparatus 107 starts capturing and storing operations from a position D, at which the laser light is irradiated, of an image bearing member on which the toner patch 108 is not formed, passes through a position E at which the laser light is irradiated on the toner patch 108, and terminates capturing and storing operations at a position F after passing through the toner patch 108.

By setting the exposure time of the line sensor to be short, and repeatedly performing capturing operation, while scanning the laser light from the position D to the position F, reflected waveforms from the image bearing member 101 or 106, and the toner patch 108 can be finely sampled and measured.

Figure 9A:
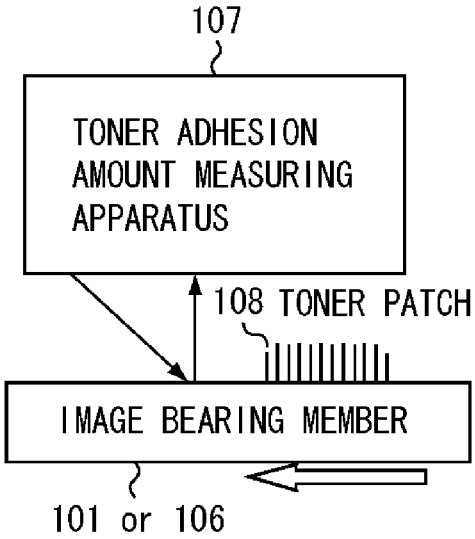
FIGS. 9A, 9B, 9C, and 9D illustrate a procedure for measuring toner adhesion amounts, and reflected waveforms detected by line sensors.
Figure 9B:
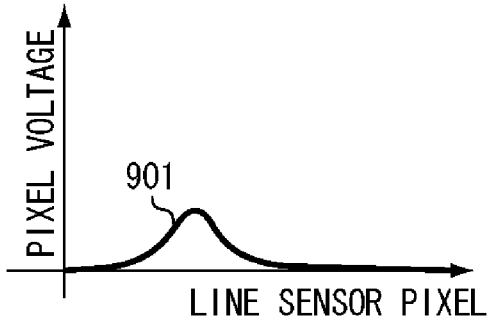

At the position D and the position F at which the image bearing member 101 or 106 portion is measured, as illustrated in FIG. 9A, only a reflected waveform 901 from the image bearing member 101 or 106 is captured and stored, as illustrated in FIG. 9B.

Figure 9C:
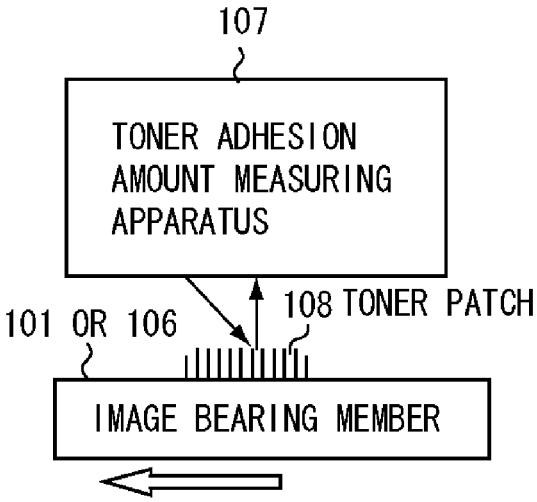
Figure 9D:
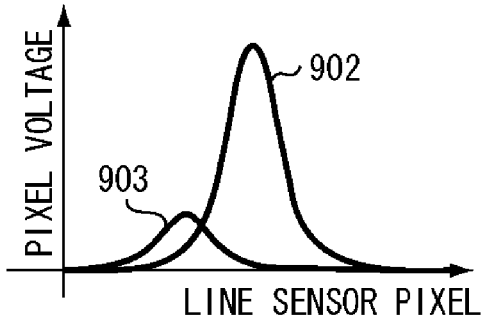

On the other hand, as illustrated in FIG. 9C, at the position E at which the toner patch 108 portion is measured, as illustrated in FIG. 9D, a reflected waveform 902 when the laser light is irradiated on screen lines of the toner patch 108, and a reflected waveform 903 when the laser light is irradiated on a portion where the image bearing member is exposed, are alternately observed. Therefore, two reflected waveforms are captured and stored alternately and in time sequence corresponding to a period of the screen pitch.

Figure 10:
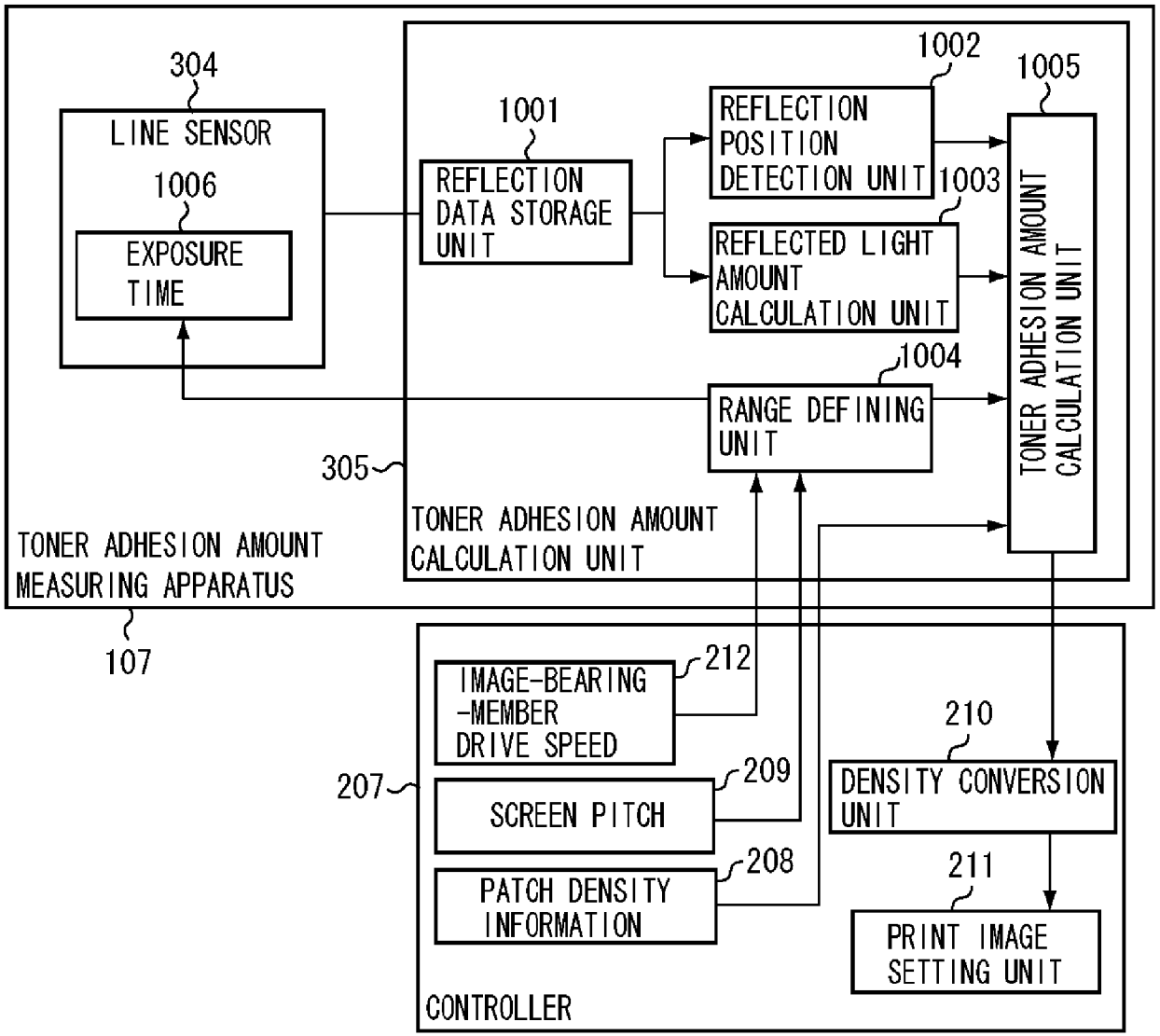
FIG. 10 is a block diagram illustrating a process of arithmetic operation of a toner adhesion amount according to the second exemplary embodiment.

Then, a process of arithmetic operation of a toner adhesion amount according to a second exemplary embodiment will be described with reference to a block diagram illustrated FIG. 10.

Figure 11:
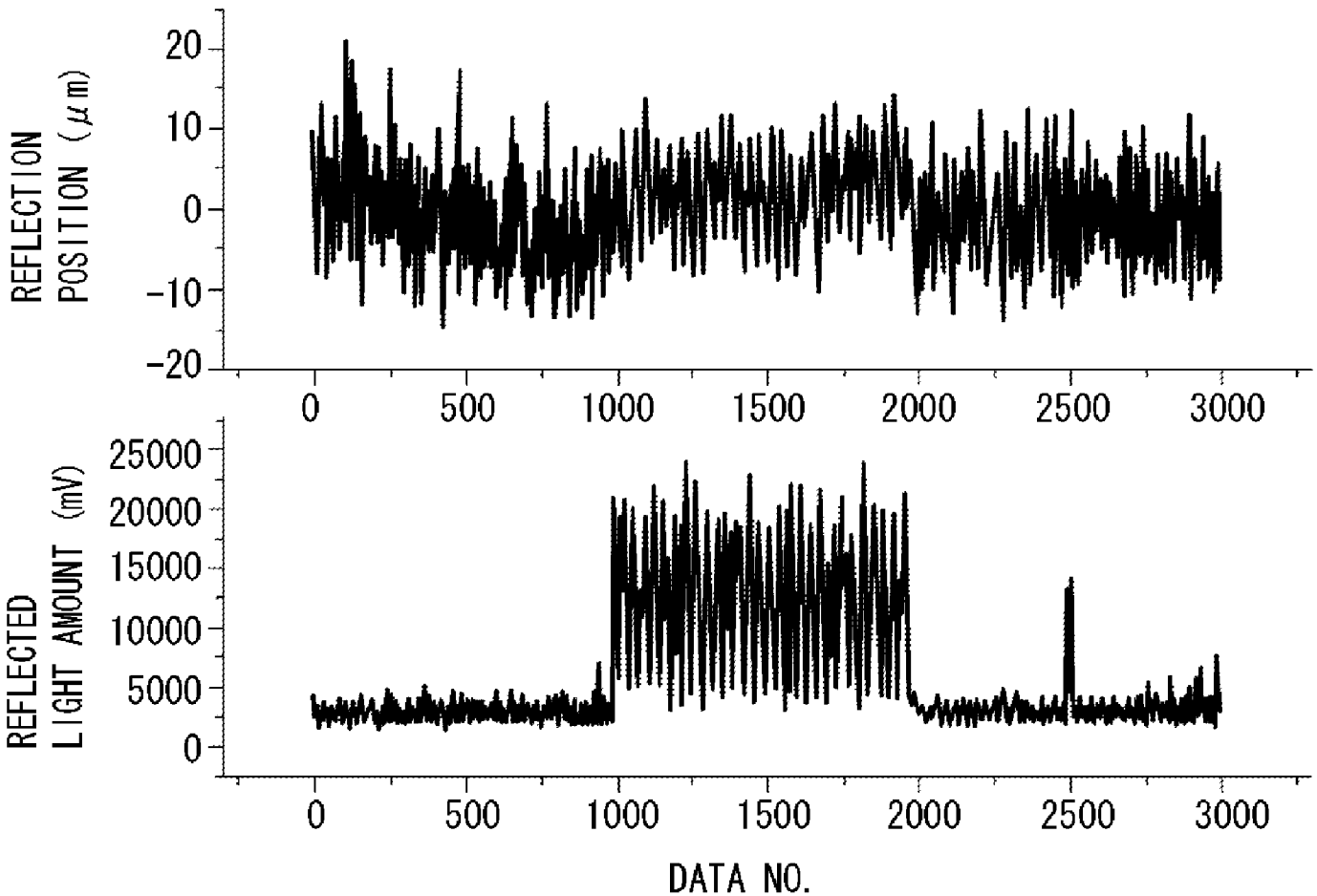
FIG. 11 is a graph illustrating profile data represented by each calculated reflection position/reflected light amount, in which each abscissa axis represents Data No. of data obtained in time sequence, and ordinates respectively represent reflection position and reflected light amount.

In a reflection position detection unit 1002 and a reflected light amount calculation unit 1003, position of peak apex and peak area are arithmetically operated on all sampled reflection waveform data stored in a reflection data storage unit 1001. More specifically, the reflection position detection unit 1002 and the reflected light amount calculation unit 1003 calculate profile data illustrated in FIG. 11. In FIG. 11, the abscissa data represents numbers of data obtained in time sequence, and the ordinate represents each calculated reflection positions and reflected light amounts.

In the present exemplary embodiment, when an average reflection position or average reflected light amount of the toner patch portion is calculated from the calculated profile data, a range definition of measurement is implemented by defining a number of data plots to be used in the calculation to a number of plots equivalent to integer multiple of the screen pitch.

More specifically, a range defining unit 1004 calculates a number of plots N equivalent to integer multiple of the screen pitch from the image-bearing-member drive speed 212 and the screen pitch 209 acquired from the controller 207, and an exposure time 1006 acquired from the line sensor 304.

A toner adhesion amount calculation unit 1005 calculates the toner adhesion amount from the number of plots N calculated by the range defining unit 1004, and the patch density information 208 acquired from the controller 207, and the profile data of the reflection positions or the reflected light amounts. The number of plots N equivalent to integer multiple of the screen pitch is calculated by the following formula (5).

$$N=np/VT\ (n=1,2,\ldots) \quad (5)$$

Figure 12:
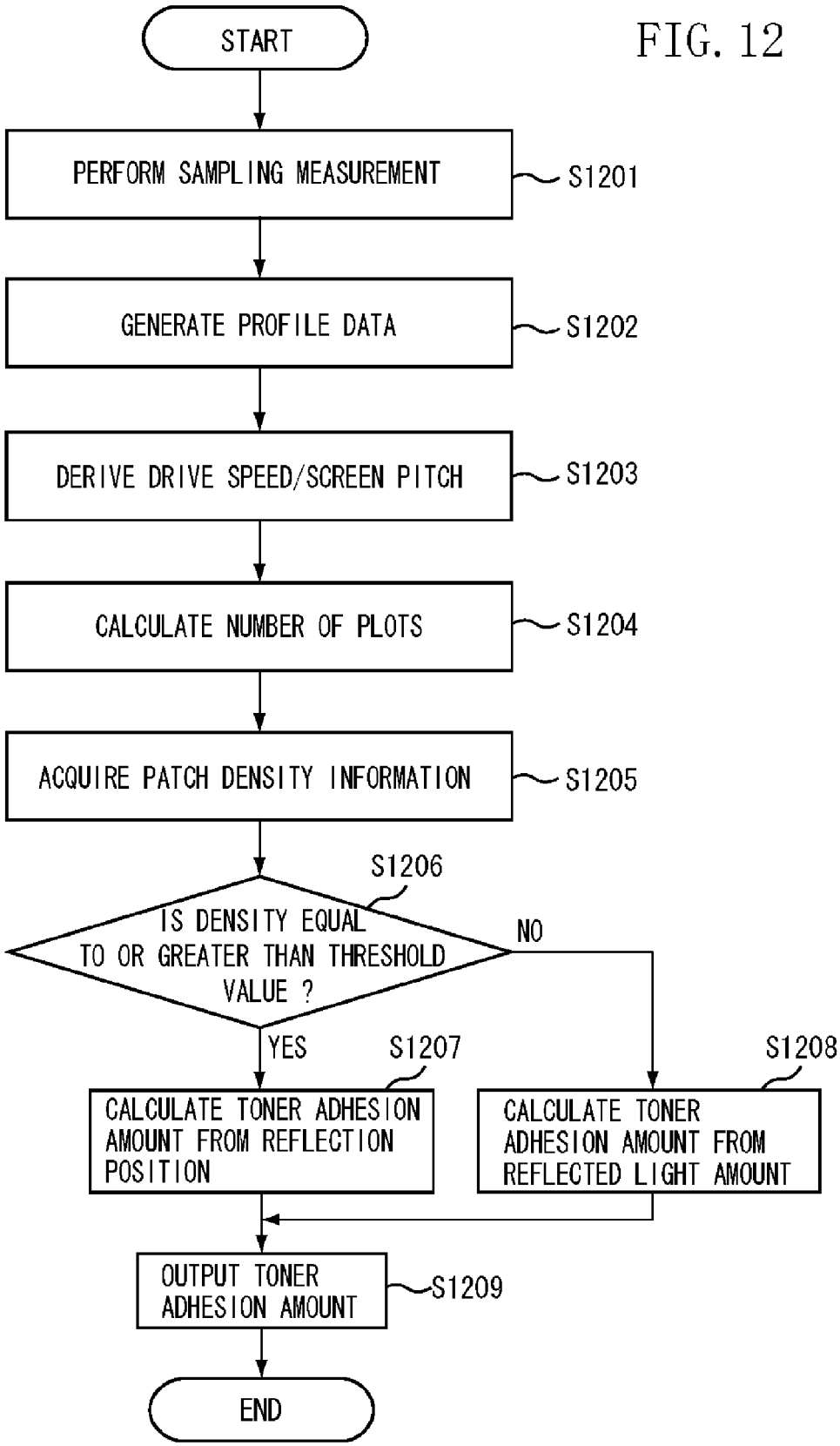
FIG. 12 is a flowchart illustrating processing of a toner adhesion amount arithmetic operation unit according to the third exemplary embodiment.

FIG. 12 is a flowchart illustrating processing performed by a toner adhesion amount arithmetic operation unit 305 according to the present exemplary embodiment.

In step S1201, the toner adhesion amount arithmetic operation unit 305 performs sampling measurement of the reflected waveforms. Then in step S1202, the reflection position detection unit 1002 and the reflected light amount calculation unit 1003 generate the profile data of the reflection positions and the reflected light amounts. Then in step S1203, the range defining unit 1004 acquires the image-bearing-member drive speed 212, the screen pitch 209, and the exposure time 1006 of the line sensor.

Then in step S1204, the range defining unit 1004 calculates a number of data plots N equivalent to integer multiple of the screen pitch, based on the image-bearing-member drive speed 212, the screen pitch 209, and the exposure time 1006 of the line sensor. In step S1205, the toner adhesion amount calculation unit 1005 acquires patch density information 208 from the controller 207.

Then in step S1206, the toner adhesion amount calculation unit 1005 performs a density evaluation by comparing with a threshold. More specifically, if patch density information is equal to or greater than the threshold value (YES in step S1206), the toner adhesion amount calculation unit 1005 determines the patch density as a high density region where accuracy by reflection position detection is high. In step S1207, the toner adhesion amount calculation unit 1005 calculates a toner adhesion amount from reflection position data. On the other hand, if the patch density information is less than the threshold value (NO in step S1206), the toner adhesion amount calculation unit 1005 determines the patch density as a low density region where accuracy by the reflected light amount detection is high. In step S1208, the toner adhesion amount calculation unit 1005 calculates a toner adhesion amount from the reflected light amount data.

Then, in step S1209, the toner adhesion amount calculation unit 1005 outputs the calculated toner adhesion amount. The image forming apparatus controls various parameters (image forming parameters) such as exposure amount, developing voltage, transfer current, based on the output toner adhesion amount. The controller 207 controls the image forming apparatus, based on the toner adhesion amount measured with high accuracy by the above-described toner adhesion amount measuring apparatus 107.

Next, a third exemplary embodiment will be described. Hereinbelow, a method for measuring a toner adhesion amount in the third exemplary embodiment will be described.

In the present exemplary embodiment, similarly to the second exemplary embodiment, the image bearing member and the toner image are sampled and measured in a short exposure time. Then, when the toner adhesion amount is arithmetically operated from the profile data of the obtained reflection positions and reflected light amounts, measurement range is defined by defining a number of data to be used in the arithmetic operation to an amount equivalent to integer multiple of the screen pitch.

However, without acquiring the drive speed of image bearing member and the screen pitch from the controller, a number of plots equivalent to integer multiple of the screen pitch is automatically calculated from the profile data. In the present exemplary embodiment, the same reference numerals are designated to elements and parts similar to those in the second exemplary embodiment, and the description will be omitted.

Figure 13:
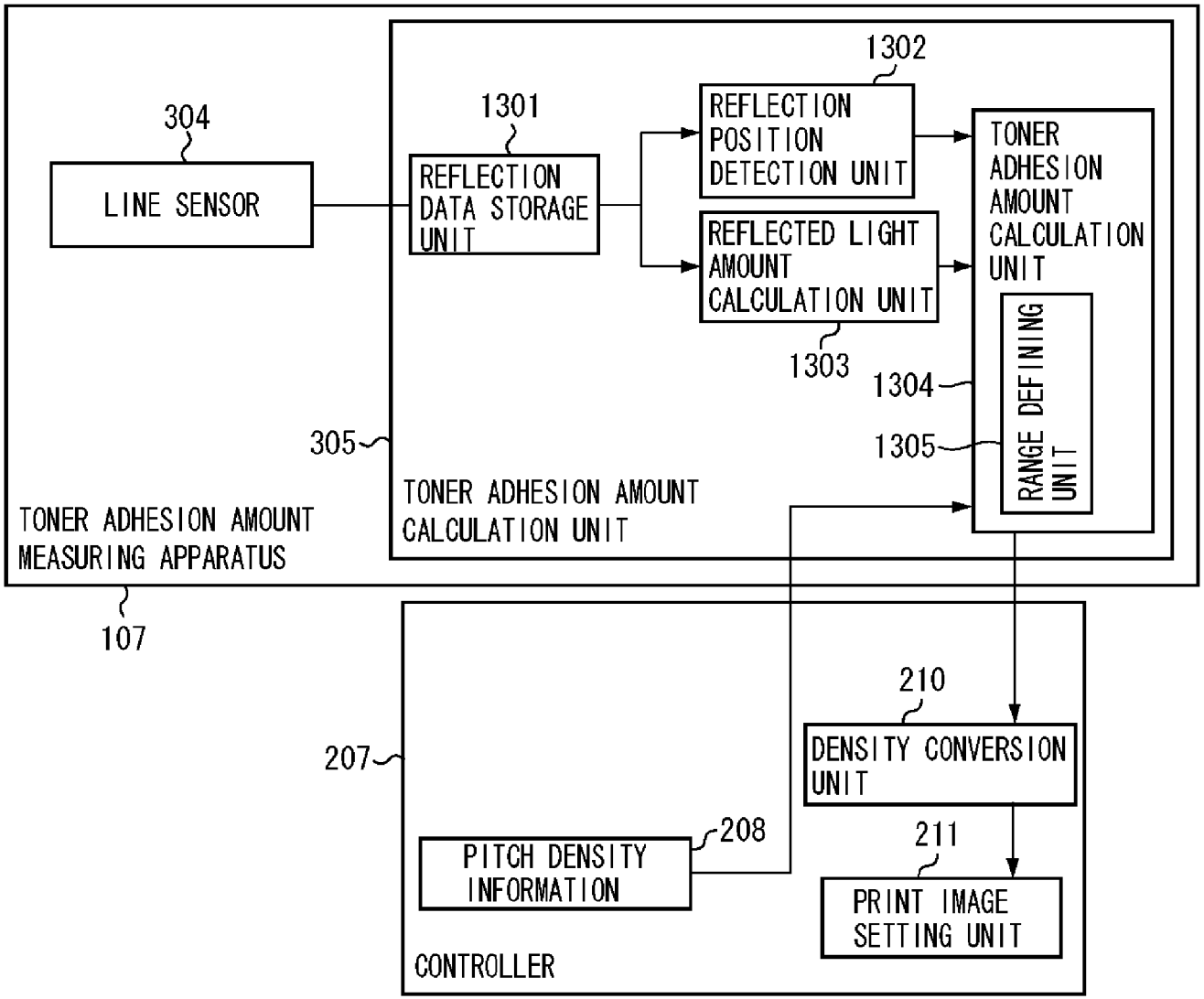
FIG. 13 is a block diagram illustrating a process of arithmetic operation of a toner adhesion amount according to the third exemplary embodiment.

A process of arithmetic operation of the toner adhesion amount in the third exemplary embodiment will be described with reference to the block diagram illustrated in FIG. 13.

The reflection waveform data that is sampled and measured by the line sensor 304 is stored in the reflection data storage unit 1301, and profile data is generated by the reflection position detection unit 1302 and the reflected light amount calculation unit 1303.

Figure 14:
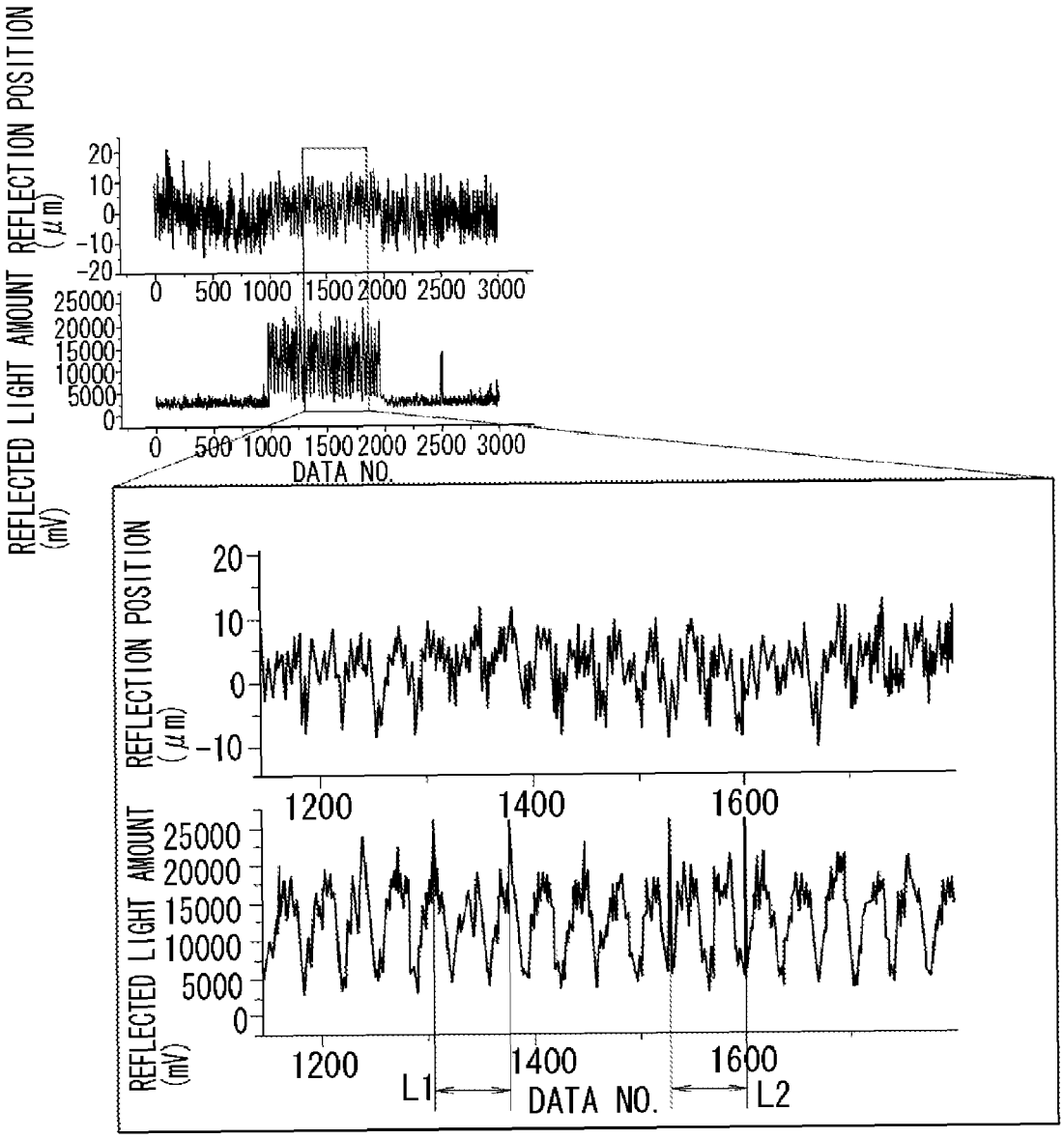
FIG. 14 is a graph illustrating a method for calculating number of plots equivalent to integer multiple of screen pitch according to the third exemplary embodiment.

In the range defining unit 1305, two peak apexes of periodically varying signals observed in the toner patch portion of the generated profile data are detected. Then, the range defining unit 1305 detects a distance L1 between the peak apexes illustrated in FIG. 14, and calculate a number of plots N equivalent to integer multiple of the screen pitch from the L1, as given in formula (6). Alternatively, the range defining unit 1305 may detect two valley points of the profile data, and calculate the number of plots N from a distance L2 between valley points. Further, L1 and L2 may be calculated from profile data of the reflection positions, or may be calculated from profile data of the reflected light amounts.

$$N=L1 \text{ or } L2 \quad (6)$$

In the toner adhesion amount calculation unit 1304, profile data is averaged based on the number of plots N calculated by the range defining unit 1305, and patch density information, and the toner adhesion amounts are calculated.

Figure 15:
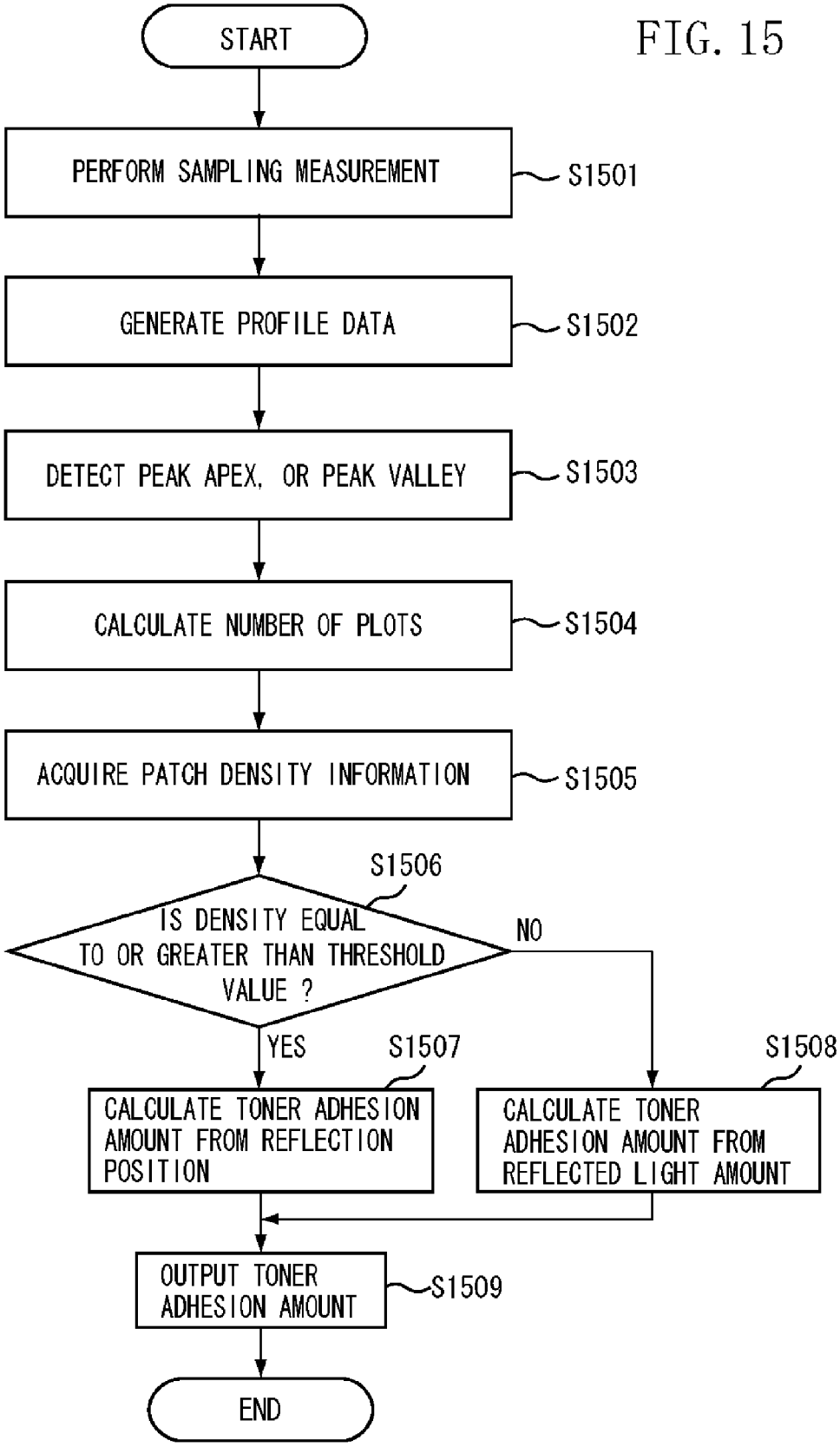
FIG. 15 is a flowchart illustrating processing of the toner adhesion amount arithmetic operation unit according to the third exemplary embodiment.

FIG. 15 is a flowchart illustrating processing of the toner adhesion amount arithmetic operation unit 305 in the present exemplary embodiment.

First, in step S1501, the toner adhesion amount arithmetic operation unit 305 performs sampling measurement of the reflected waveforms. Then in step S1502, the reflection position detection unit 1302 and the reflected light amount calculation unit 1303 generate profile data of the reflection positions and the reflected light amounts. Then in step S1503, the range defining unit1305 detects two peak apexes, or two valley points from the profile data generated in step S1502.

Then in step S1504, the range defining unit 1305 calculates a distance between peak apexes, or a number of plots N equivalent to integer multiple of the screen pitch from the distance between the peak apexes. Then in step S1505, the toner adhesion amount calculation unit 1304 acquires patch density information 208 from the controller 207.

Then, in step S1506, the toner adhesion amount calculation unit 1304 performs a density evaluation by comparing with a threshold value. More specifically, if patch density information is equal to or greater than the threshold value (YES in step S1506), the toner adhesion amount calculation unit 1304 determines the patch density as a high density region where accuracy by the reflection position detection is high. In step S1507, the toner adhesion amount calculation unit 1304 calculates a toner adhesion amount from reflection position data.

On the other hand, if the patch density information is less than the threshold value (NO in step S1506), the toner adhesion amount calculation unit 1304 determines the pitch density as a low density region where accuracy by reflected light amount detection is high. In step S1508, the toner adhesion amount calculation unit 1304 calculates a toner adhesion amount from the reflected light amount data.

Then in step S1509, the toner adhesion amount calculation unit 1304 outputs the calculated toner adhesion amount. The image forming apparatus controls various parameters (image forming parameters) such as exposure amount, developing voltage, transfer current, based on the output toner adhesion amount. The controller 207 controls the image forming apparatus, based on the toner adhesion amount measured with high accuracy by the toner adhesion amount measuring apparatus 107 as described above.

Next, a fourth exemplary embodiment will be described. Hereinbelow, a method for measuring a toner adhesion amount in the fourth exemplary embodiment will be described.

In the present exemplary embodiment, similarly to the third exemplary embodiment, the image bearing member and the toner images are sampled and measured in a short exposure time, and a number of plots equivalent to integer multiple of the screen pitch is automatically calculated from profile data. However, frequency of profile data is analyzed, instead of detecting peak apexes and valley points, and a number of plots equivalent to integer multiple of screen is calculated from its period. In the present exemplary embodiment, the same reference numerals are designated to elements and components similar to those of the third exemplary embodiment, and the detailed description will be omitted.

Figure 16:
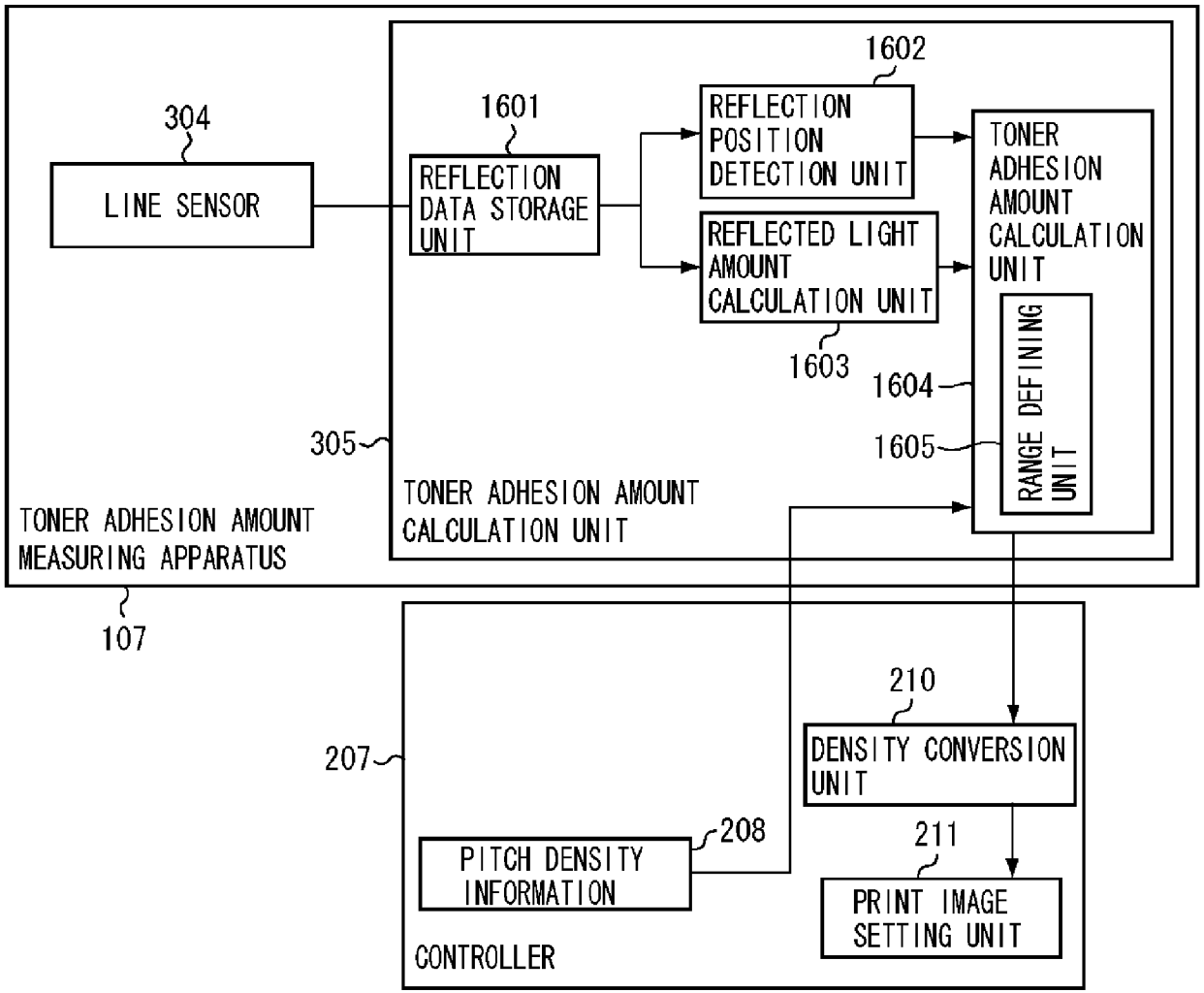
FIG. 16 is a block diagram illustrating a process of arithmetic operation of a toner adhesion amount according to the fourth exemplary embodiment.

A process of arithmetic operation of the toner adhesion amount in the fourth exemplary embodiment will be described with reference to the block diagram illustrated in FIG. 16.

Reflection waveform data sampled and measured by the line sensor 304 is stored in a reflection data storage unit 1601, and profile data is generated by a reflection position detection unit 1602 and a reflected light amount calculation unit 1603.

Figure 17:
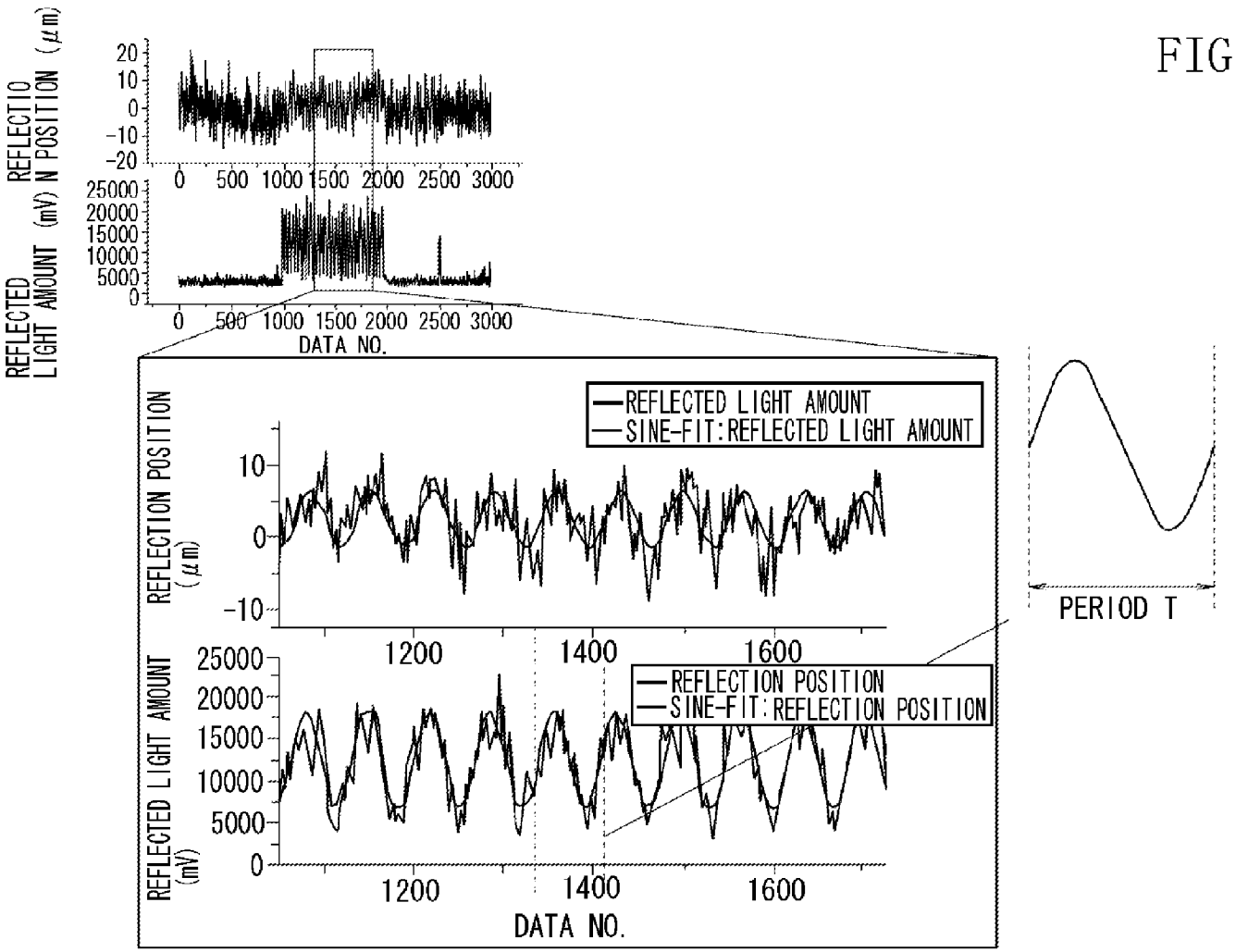
FIG. 17 is a graph illustrating a method for calculating number of plots equivalent to integer multiple of screen pitch according to the fourth exemplary embodiment.

A range defining unit 1605 analyzes frequency of periodically varying signals observed in toner patch portion of generated profile data, and calculates a number of plots N equivalent to integer multiple of the screen pitch from its period T (Refer to FIG. 17), as given in formula (7).

$$N=T \tag{7}$$

A toner adhesion amount calculation unit 1604 averages profile data based on the number of plots N calculated by the range defining unit 1605 and the patch density information, and calculates toner adhesion amounts.

Figure 18:
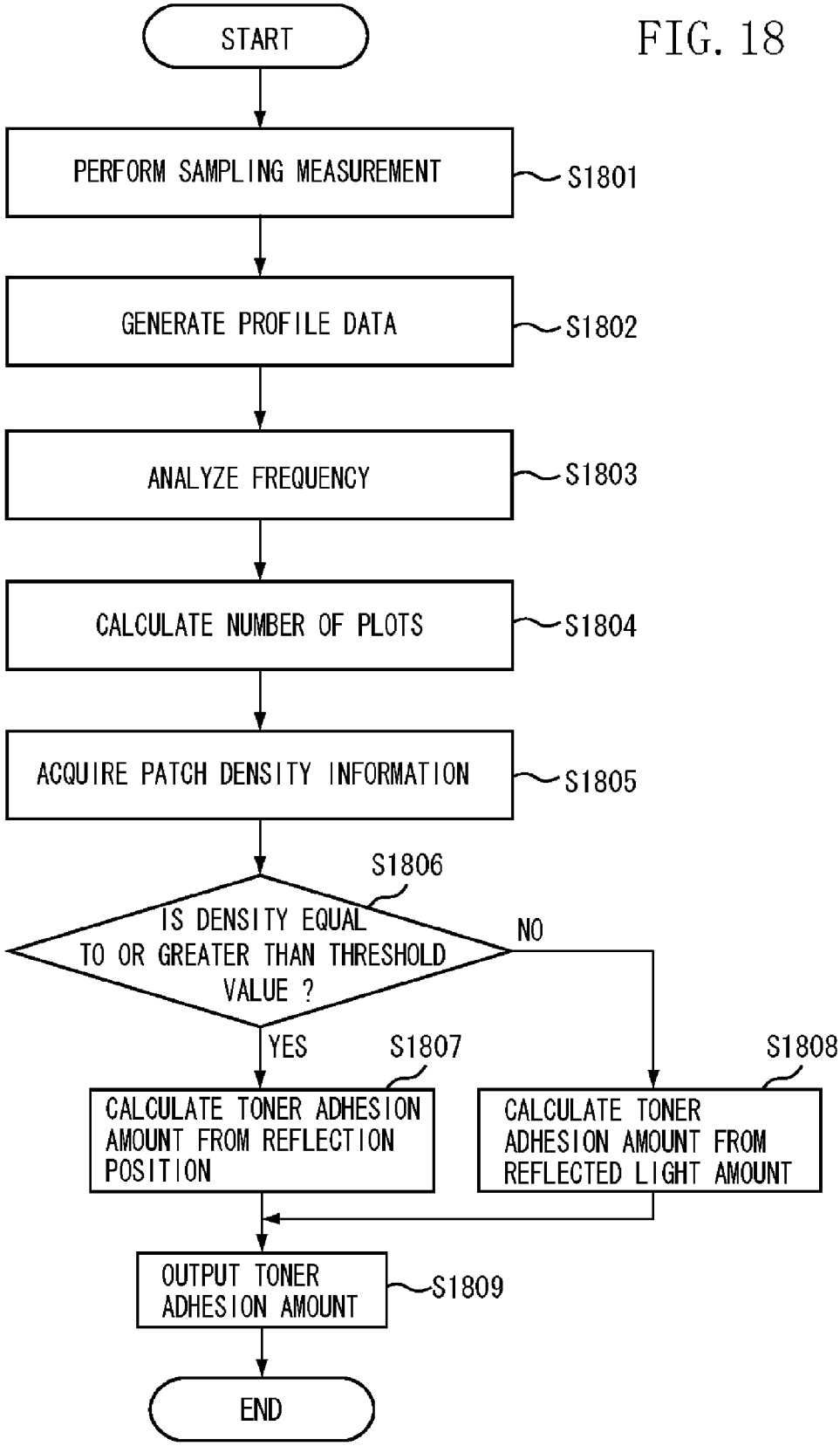
FIG. 18 is a flowchart illustrating processing of the toner adhesion amount arithmetic operation unit according to the fourth exemplary embodiment.

FIG. 18 is a flowchart illustrating processing of the toner adhesion amount arithmetic operation unit 305 according to the present exemplary embodiment.

First in step S1801, the toner adhesion amount arithmetic operation unit 305 performs sampling measurement of the reflected waveforms. Then in step S1802, the reflection position detection unit 1602 and the reflected light amount calculation unit 1603 generate profile data of the reflection positions and the reflected light amounts. Then in step S1803, the range defining unit 1605 analyzes frequency of profile data generated in step S1802.

Then, in step S1804, the range defining unit 1605 calculates a number of plots N equivalent to integer multiple of screen from a period T corresponding to the analyzed frequency. Then, in step S1805, the toner adhesion amount calculation unit 1604 acquires patch density information from the controller 207.

Then, in step S1806, the toner adhesion amount calculation unit 1604 performs a density evaluation by comparing with a threshold. More specifically, if patch density information is equal to or greater than a threshold value (YES in step S1806), the toner adhesion amount calculation unit 1604 determines the patch density as a high density region where accuracy by reflection position detection is high. In step S1807, the toner adhesion amount calculation unit 1604 calculates a toner adhesion amount from reflection position data.

On the other hand, if the patch density information is less than the threshold value (NO in step S1806), the toner adhesion amount calculation unit 1604 determines the patch density as a low density region where accuracy by reflected light amount detection is high. In step S1808, the toner adhesion amount calculation unit 1604 calculates a toner adhesion amount from reflected light amount data.

Then, in step S1809, the toner adhesion amount calculation unit 1604 outputs the calculated toner adhesion amount. The image forming apparatus controls various parameters (image forming parameters) such as exposure amount, developing voltage, and transfer current, based on the output toner adhesion amount. The controller 207 controls the image forming apparatus, based on the toner adhesion amount measured with high accuracy by the toner adhesion amount measuring apparatus 107 as described above.

Figure 19:
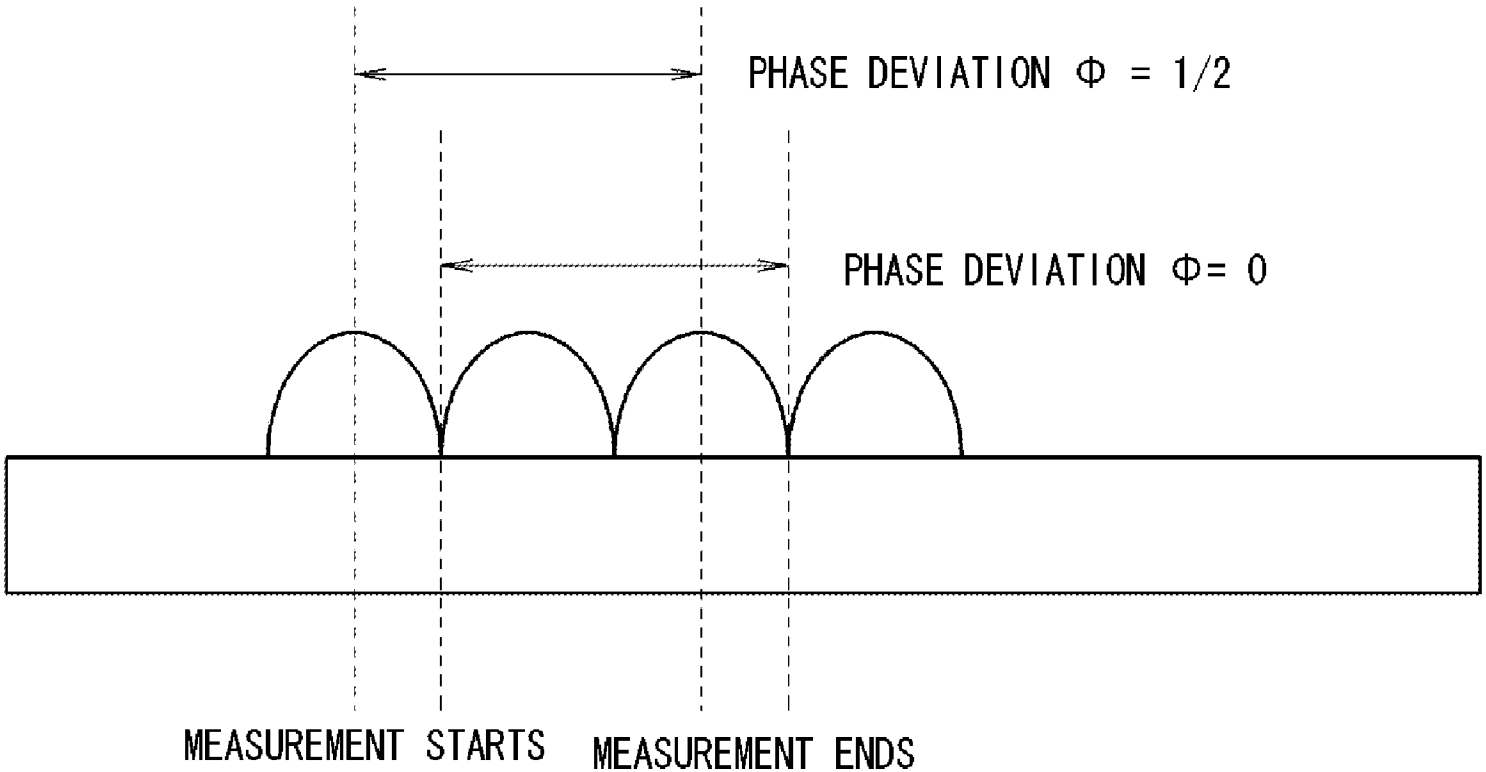
FIG. 19 illustrates measurement range of toner patch according to the exemplary embodiments.

FIG. 19 illustrates measurement range of the toner patch according to the exemplary embodiments. As illustrated in FIG. 19, according to the exemplary embodiment as described above, the controller 207 controls at least one of image sensor (line sensor), storage unit, and toner adhesion amount arithmetic operation unit of the toner adhesion amount measuring apparatus, and defines a range within which the toner patch is measured, to an integer multiple of a screen pitch.

Accordingly, even in a case where phase of measurement starting position and screen period has changed, variations of reflected signals to be detected can be suppressed, and errors of the toner adhesion amount measurement can be reduced, thereby enhancing measurement accuracy. Further, since allowance can be put into position and timing of measurement starting, mechanical design of attachment accuracy of a driving system such as a motor or a roller, and sensors becomes easy.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-330913 filed Dec. 25, 2008, which is hereby incorporated by reference herein in its entirety.

What is claimed is:

1. An apparatus for measuring a toner adhesion amount of a toner image formed on an image bearing member of an image forming apparatus, the apparatus comprising:

a deriving unit configured to derive the toner adhesion amount, based on data in a range of integer multiple of screen pitch of the toner image, the data obtained by detecting reflected light from the toner image.

2. The apparatus according to claim 1, further comprising a scanning unit configured to scan irradiated light.

3. The apparatus according to claim 1, further comprising:

a position detection unit configured to detect reflection position of detected reflected light; and a calculation unit configured to calculate reflected light amount of the detected reflected light, wherein the deriving unit calculates the toner adhesion amount, based on the detected reflection position or the calculated reflected light amount.

4. The apparatus according to claim 3, wherein the position detection unit detects the reflection position of the reflected light, by detecting a peak position of reflection waveform data output from the detection unit.

5. The apparatus according to claim 3, wherein the calculation unit calculates the reflected light amount, by calculating an area of peak portion of the reflection waveform data output from the detection unit.

6. The apparatus according to claim 3, wherein the deriving unit switches between calculating the toner adhesion amount based on the reflection position of the reflected light, according to density information of the toner image, and calculating the toner adhesion amount, based on the reflected light amount.

7. The apparatus according to claim 1, further comprising an irradiation unit configured to irradiate light on the toner image.

8. The apparatus according to claim 1, further comprising a detection unit configured to detect the reflected light from the toner image.

9. An apparatus comprising:

an irradiation unit configured to irradiate light onto a toner image formed on an image bearing member of the apparatus;

a detection unit configured to detect reflected light from the toner image;

a deriving unit configured to derive a toner adhesion amount of the toner image, based on detection result by the detection unit in a range of integer multiple of screen pitch of the toner image; and an image forming unit configured to form an image based on set value corrected based on the derived toner adhesion amount.

10. A method for measuring a toner adhesion amount of a toner image formed on an image bearing member of an apparatus, comprising:

deriving the toner adhesion amount, based on data in a range of integer multiple of screen pitch of the toner image, the data being obtained by detecting reflected light from the toner image.

11. The method according to claim 10, further comprising scanning irradiated light by a scanning unit.

12. The method according to claim 10, further comprising:

detecting reflection position of detected reflected light by a position detection unit; and calculating reflected light amount of the detected reflected light by a calculation unit, wherein the toner adhesion amount is derived based on the detected reflection position or the calculated reflected light amount.

13. The method according to claim 12, wherein the detecting reflection position is detected, by detecting a peak position of reflection waveform data output from the detection unit.

14. The method according to claim 12, wherein the calculating reflected light amount includes calculating an area of peak portion of the reflection waveform data output from the detection unit.

15. The method according to claim 12, further comprises switching between calculating the toner adhesion amount based on the reflection position of the reflected light, according to density information of the toner image, and calculating the toner adhesion amount, based on the reflected light amount.

* * * * *